US008618738B2

(12) United States Patent
Wen et al.

(10) Patent No.: US 8,618,738 B2
(45) Date of Patent: Dec. 31, 2013

(54) LIGHT SOURCE SYSTEM AND METHOD FOR DRIVING LIGHT EMITTING DIODES

(75) Inventors: Chun-Kuei Wen, Hsinchu (TW); Shih-Chieh Kuo, Taipei County (TW); Che-Hsien Chen, Kaohsiung (TW); Hung-Min Huang, Tainan (TW)

(73) Assignee: Au Optronics Corporation, Hsinchu (TW)

( * ) Notice: Subject to any disclaimer, the term of this patent is extended or adjusted under 35 U.S.C. 154(b) by 323 days.

(21) Appl. No.: 13/042,469

(22) Filed: Mar. 8, 2011

(65) Prior Publication Data

US 2012/0119673 A1 May 17, 2012

(30) Foreign Application Priority Data

Nov. 12, 2010 (TW) ..... 99139031 A

(51) Int. Cl.
*H05B 37/00* (2006.01)

(52) U.S. Cl.
USPC ..... 315/192; 315/294; 315/307

(58) Field of Classification Search
USPC ..... 315/185 R, 186, 192, 291, 294, 307, 360
See application file for complete search history.

(56) References Cited

U.S. PATENT DOCUMENTS

| | | | | |
|---|---|---|---|---|
| 7,317,288 | B2 | 1/2008 | Lin et al. | |
| 8,022,634 | B2 * | 9/2011 | Greenfeld | 315/192 |
| 8,044,609 | B2 * | 10/2011 | Liu | 315/291 |
| 8,134,253 | B2 | 3/2012 | Watanabe | |
| 8,354,804 | B2 * | 1/2013 | Otake et al. | 315/308 |
| 2004/0085030 | A1 * | 5/2004 | Laflamme et al. | 315/291 |
| 2007/0052375 | A1 | 3/2007 | Lin et al. | |
| 2007/0211014 | A1 | 9/2007 | Kim et al. | |
| 2010/0090530 | A1 | 4/2010 | Watanabe | |
| 2011/0037396 | A1 * | 2/2011 | Chien et al. | 315/185 R |
| 2011/0062872 | A1 * | 3/2011 | Jin et al. | 315/122 |
| 2011/0062887 | A1 * | 3/2011 | Hsu et al. | 315/294 |
| 2011/0084620 | A1 * | 4/2011 | Lee | 315/186 |
| 2011/0140627 | A1 * | 6/2011 | Kong et al. | 315/250 |

FOREIGN PATENT DOCUMENTS

| | | |
|---|---|---|
| CN | 1801310 | 7/2006 |
| CN | 101589539 | 11/2009 |
| TW | I269514 | 12/2006 |

OTHER PUBLICATIONS

"Office Action of China Counterpart Application", issued on Mar. 26, 2012, p. 1-p. 6, in which the listed references were cited.

* cited by examiner

*Primary Examiner* — Tung X Le
(74) *Attorney, Agent, or Firm* — Jianq Chyun IP Office

(57) ABSTRACT

A light source system and a method for driving light emitting diodes (LEDs) are provided. The provided light source system includes: an LED module having a plurality of LED strings operated under a direct current (DC) output voltage; and a driving unit coupled to the LED module, and used for providing the DC output voltage by adopting a boost means and generating a plurality of pulsation current signals according to a setting signal so as to respectively drive the LED strings, in which the frequencies of the pulsation current signals are higher than a predetermined frequency.

14 Claims, 5 Drawing Sheets

LIGHT SOURCE SYSTEM AND METHOD FOR DRIVING LIGHT EMITTING DIODES

CROSS-REFERENCE TO RELATED APPLICATION

This application claims the priority benefit of Taiwan application serial no. 99139031, filed Nov. 12, 2010. The entirety of the above-mentioned patent application is hereby incorporated by reference herein and made a part of this specification.

BACKGROUND OF THE INVENTION

1. Field of the Invention

The present invention generally relates to a light source system, in particular, to a light source system and a driving method for light emitting diodes (LEDs).

2. Description of Related Art

Recently, with the vigorous development of semiconductor technology, portable electronic products and flat panel display (FPD) products also rise. Among many types of the FPDs, the liquid crystal display (LCD) immediately becomes the mainstream of various display products due to advantages such as low-voltage operation, radiation-free line scattering, a light weight, and a small volume. Generally, an LCD panel itself does not have the characteristic of light-emission, and thus it is necessary to dispose a backlight module below the LCD panel, so as to provide the required light (backlight) source for the LCD panel.

The conventional backlight module may be roughly divided into two categories: the backlight module formed by cold cathode fluorescent lamps (CCFLs), and the backlight module formed by LEDs. As the LED backlight module is capable of improving the color gamut of the LCD, currently most panel manufacturers replace the CCFL backlight module with the LED backlight module.

The LED backlight module has a plurality of parallel LED strings, and each LED string is formed by a plurality of LEDs connected in series. In practice, each LED string is operated under a direct current (DC) output voltage provided by a boost circuit. Besides, a driver for driving the LED strings generates a plurality of pulsation current signals in response to a setting signal provided by a system terminal, so as to respectively drive the LED strings. Specifically, both the frequency and the duty cycle of each pulsation current signal generated by the driver are in accordance with the frequency and the duty cycle of the setting signal provided by the system terminal.

However, as the frequency of the setting signal provided by the system terminal is limited within 200 Hz to 20 KHz, an output capacitor (Cout) of the boost circuit generates resonance with the print circuit board (PCB) in response to the pulsation of the pulsation current signals generated by the driver, so as to produce acoustic noises. Moreover, if the frequency of the setting signal provided by the system terminal (that is, the frequency of the pulsation current signal) is close to the multiple of the frame rate of the LCD (for example, 240 Hz, 300 Hz, etc.), it is more likely that unnecessary oblique or horizontal stripes (i.e. wave noises) are generated in images displayed by the LCD, which may affect the quality of the frame.

SUMMARY OF THE INVENTION

Accordingly, the present invention is directed to a light source system and a method for driving LEDs so as to effectively solve the problems in the prior art.

In an embodiment, the present invention provides a light source system, which includes an LED module and a driving unit. The LED module has a plurality of LED strings operated under a DC output voltage. The driving unit is coupled to the LED module, and used for providing the DC output voltage by adopting a boost means and generating a plurality of pulsation current signals according to a setting signal so as to respectively drive the LED strings. The frequencies of the pulsation current signals are higher than a predetermined frequency.

In another embodiment, the present invention further provides a method for driving LEDs, applicable to driving a plurality of LED stings, which includes providing a DC output voltage by adopting a boost means so as to enable the LED strings to be operated under the DC output voltage; and generating a plurality of pulsation current signals according to a setting signal so as to respectively drive the LED strings. The frequencies of the pulsation current signals are higher than a predetermined frequency.

In an embodiment of the present invention, the frequencies of the pulsation current signals may be the same or different from each other.

In an embodiment of the present invention, the frequency of each pulsation current signal has a multiple relation with the predetermined frequency, and the multiple relation may be greater than or equal to an integral or a non-integral multiple of one.

In an embodiment of the present invention, the predetermined frequency is a highest audio frequency in an audible acoustic wave range.

Based on the above descriptions, the present invention mainly designs the frequencies of the pulsation current signals for driving the respective LED strings into frequencies higher than the audible acoustic wave range (that is, 20 Hz to 20 KHz). Therefore, the intensities of the acoustic noises produced by the resonance between the output capacitor used in the adopted boost means and the PCB can be significantly suppressed. Moreover, as the frequencies of the pulsation current signals for driving the LED strings may also be designed into different values, unnecessary oblique or horizontal stripes (i.e. wave noises) can be avoided in the images displayed by the LCD if the light source system of the present invention is applied in the LCD system.

It should be understood that the above descriptions and the following specific implementations are only for illustration and explanation, and are not intended to limit the claimed scope of the present invention.

BRIEF DESCRIPTION OF THE DRAWINGS

The accompanying drawings are included to provide a further understanding of the invention, and are incorporated in and constitute a part of this specification. The drawings illustrate embodiments of the present invention and, together with the description, serve to explain the principles of the present invention.

DESCRIPTION OF THE EMBODIMENTS

Figure 1:
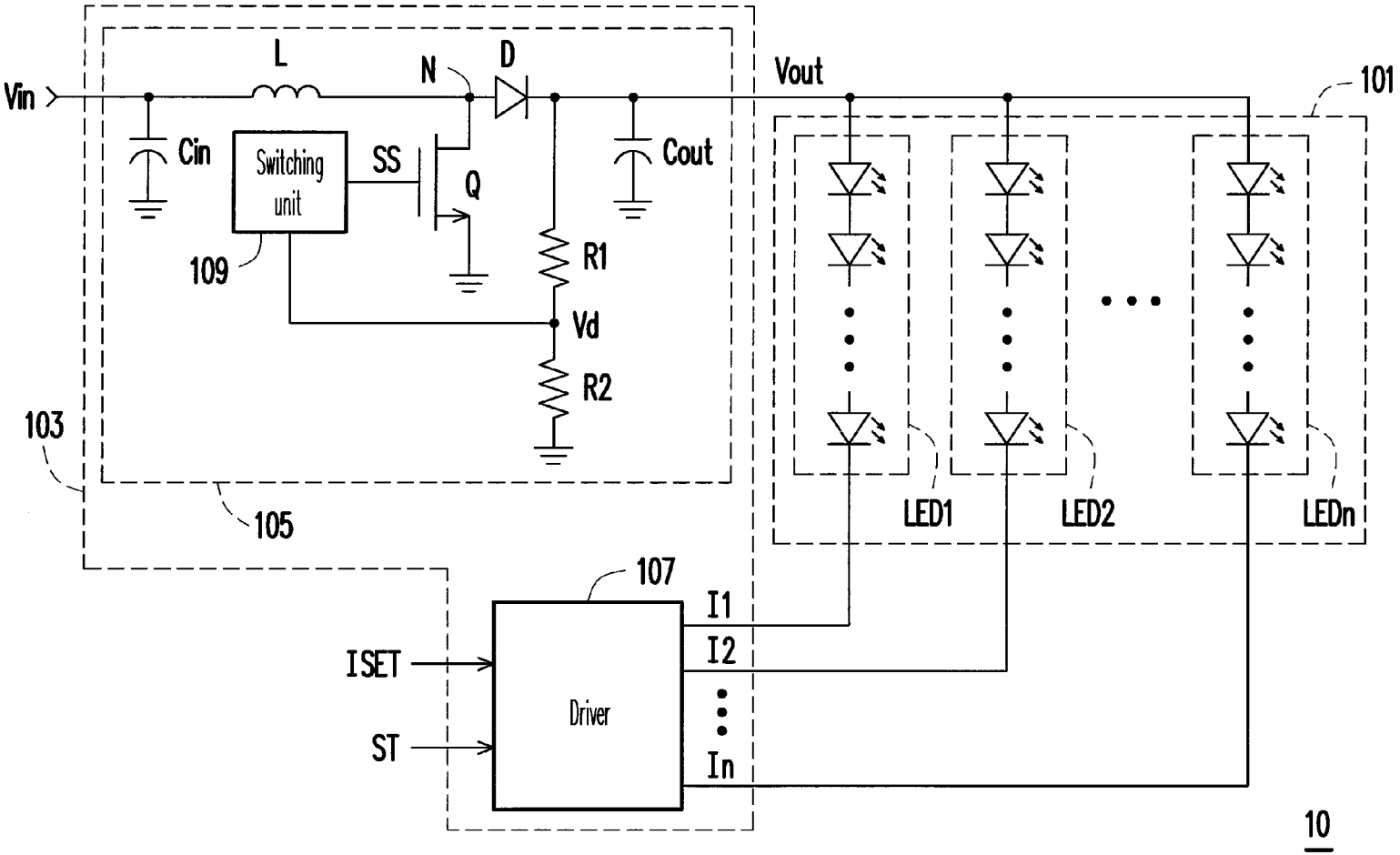
FIG. 1 is a diagram of a light source system 10 according to an embodiment of the present invention.

Reference will now be made in detail to the present embodiments of the invention, examples of which are illustrated in the accompanying drawings. Wherever possible, the same reference numbers are used in the drawings and the description to refer to the same or like parts.

FIG. 1 is a diagram of a light source system 10 according to an embodiment of the present invention. Referring to FIG. 1, the light source system 10 of this embodiment may be, but is not limited to, an LED backlight module applicable in an LCD system, and includes an LED module 101 and a driving unit 103. The LED module 101 has a plurality of LED strings LED1 to LEDn each formed by a plurality of LEDs connected in series, and the LED strings LED1 to LEDn are operated under a DC output voltage Vout.

The driving unit 103 is coupled to the LED module 101, and used for providing the DC output voltage Vout to the LED module 101 by adopting a boost means and generating a plurality of pulsation current signals I1 to In according to a setting signal ST provided by a system terminal (for example, a timing controller, but not limited thereto), so as to respectively drive the LED strings LED1 to LEDn. The frequencies of the pulsation current signals I1 to In are higher than a predetermined frequency, for example, a highest audio frequency in an audible acoustic wave range (20 Hz to 20 KHz), that is, 20 KHz, which is not limited thereto.

In this embodiment, the driving unit 103 includes a boost circuit 105 and a driver 107. The boost circuit 105 is used for receiving a DC input voltage Vin and generating the DC output voltage Vout after a boost processing of the DC input voltage Vin.

To be specific, the boost circuit 105 may include an input capacitor Cin, an inductor L, a switching unit 109, a switch Q, a diode D, resistors R1 and R2, and an output capacitor Cout. One end of the input capacitor Cin and one end of the inductor L are used for receiving the DC input voltage Vin, the other end of the input capacitor Cin is coupled to the ground, the other end of the inductor L is coupled to an anode of the diode D, and a cathode of the diode D provides the DC output voltage Vout. One end of the output capacitor Cout is coupled to the cathode of the diode D, and the other end of the output capacitor Cout is coupled to the ground.

The resistors R1 and R2 are connected between the cathode of the diode D and the ground. A first end of the switch Q is coupled to the anode of the diode D, and a second end of the switch Q is coupled to the ground. The switching unit 109 is coupled to a control end of the switch Q, and used for generating a switching signal SS to switch (that is, to turn on or off) the switch Q and continuously detecting a voltage dividing signal Vd relating to the DC output voltage Vout.

Based on this, in response to the switching of the switch Q by the switching unit 109, an alternating current (AC) voltage on a node N would be rectified and filtered by the diode D and the output capacitor Cout respectively, and thus generating the DC output voltage Vout to the LED module 101. And, the switching unit 109 further adjusts the switching signal SS according to the voltage dividing signal Vd relating to the DC output voltage Vout, so as to stabilize the DC output voltage Vout. However, if the switching unit 109 detects that the voltage dividing signal Vd relating to the DC output voltage Vout is greater than an over voltage protection (OVP) point set in the switching unit 109, it indicates that the boost circuit 105 is in an over-voltage state. In this case, the switching unit 109 immediately stops generating the switching signal SS, so as to enable the boost circuit 105 to stop generating the DC output voltage Vout.

In addition, the driver 107 is used for receiving and analyzing the setting signal ST provided by the system terminal, so as to generate the pulsation current signals I1 to In to respectively drive the LED strings LED1 to LEDn. Moreover, the driver 107 is further used for adjusting the strength (that is, amplitude) of the pulsation current signals I1 to In according to a current setting value ISET provided by the system terminal. The frequencies of the pulsation current signals I1 to In generated by the driver 107 have a multiple relation with the predetermined frequency (that is, 20 KHz), and the multiple relation may be greater than or equal to an integral or a non-integral multiple of one.

Herein, if the frequencies of the pulsation current signals I1 to In are respectively expressed as F1 to Fn, the frequencies F1 to Fn of the pulsation current signals I1 to In may be expressed in the following equations:

$$F1 = 20\ K * N1\ \text{Hz};$$

$$F2 = 20\ K * N1\ \text{Hz};$$

$$\ldots$$

$$\ldots$$

$$\ldots$$

$$Fn = 20\ K * Nn\ \text{Hz},$$

where coefficients N1, N2 . . . , Nn respectively refer to the multiple relation of the frequencies of the pulsation current signals I1 to In with the predetermined frequency (that is, 20 KHz), and the coefficients N1, N2 . . . , Nn are determined by the driver 107 itself, for example, generated by means of a random number, an increasing function, or a decreasing function, which is not limited thereto.

Figure 2A:
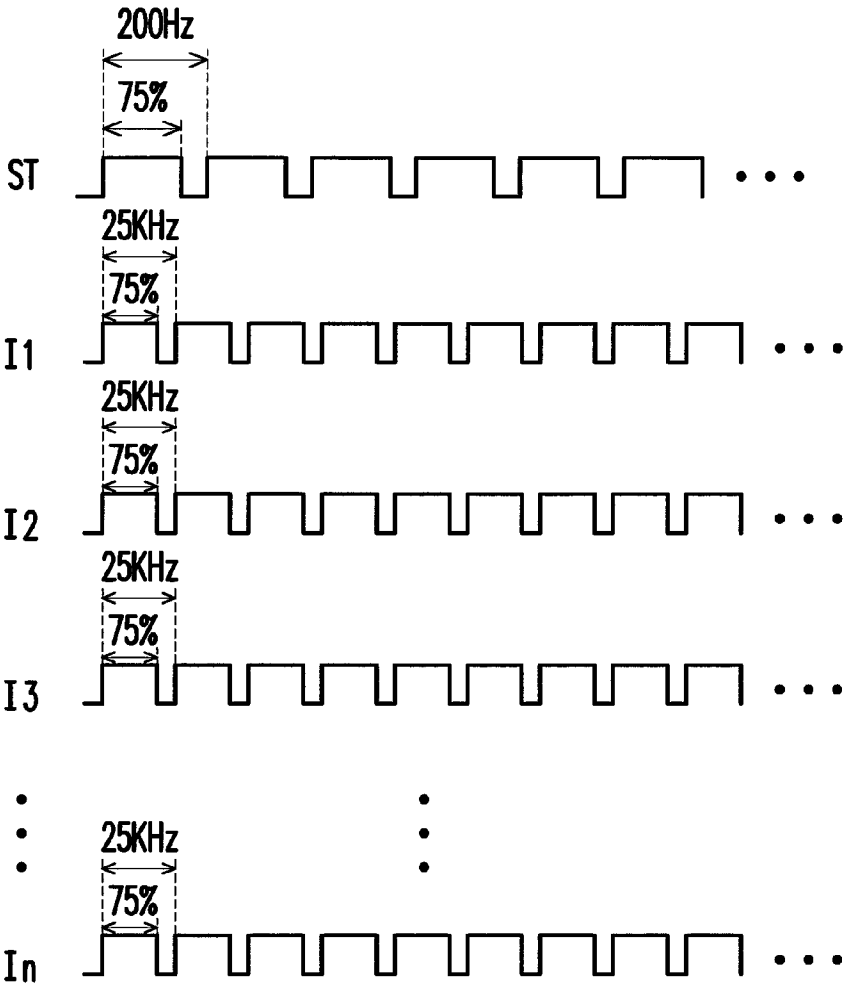
FIG. 2A to FIG. 2C are respectively a diagram of pulsation current signals I1 to In generated by a driver 107 according to an embodiment of the present invention.
Figure 2B:
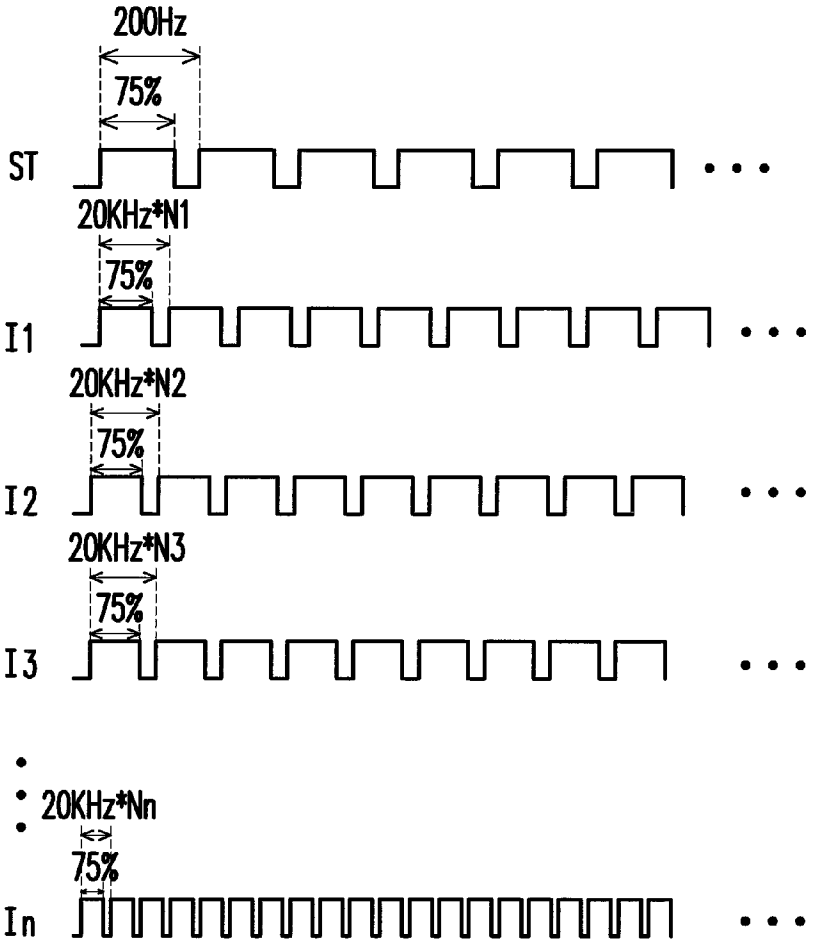
Figure 2C:
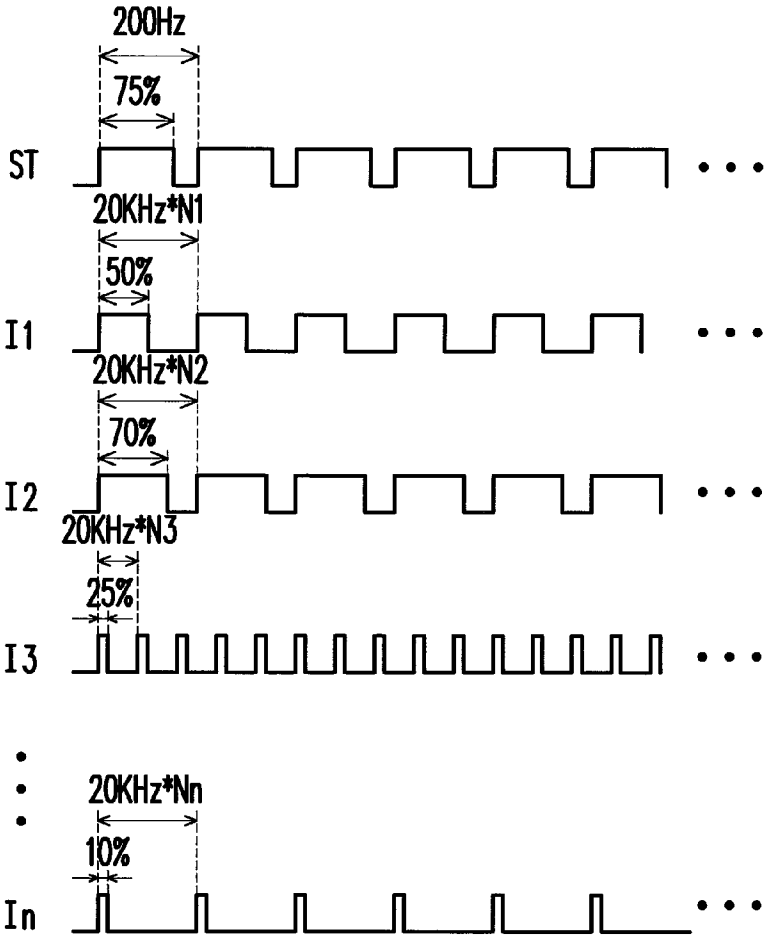

In this embodiment, if the driver 107 analyzes that the frequency and the duty cycle of the setting signal ST provided by the system terminal respectively are, for example but not limited to, 200 Hz and 75%, the driver 107 may generate the pulsation current signals I1 to In with the same or different frequencies and the same or different duty cycles. That is, the driver 107 may generate the pulsation current signals I1 to In (as shown in FIG. 2A), which have the same frequency of 25 KHz (that is, N1, N2 . . . , Nn are all 1.25, which is not limited thereto) and the same duty cycle of 75%, or generate the pulsation current signals I1 to In (as shown in FIG. 2B), which have different frequencies (that is, N1, N2 . . . , Nn are different from each other, all of which are higher than 20 KHz) and the same duty cycle of 75%, or even generate the pulsation current signals I1 to In (as shown in FIG. 2C), which have different frequencies (that is, N1, N2 . . . , Nn are different from each other, all of which are higher than 20 KHz) and different duty cycles.

It can be known that as the frequencies F1 to Fn of the pulsation current signals I1 to In used for respectively driving the LED strings LED1 to LEDn are all higher than the audible acoustic wave range (that is, 20 Hz to 20 KHz), the intensities of the acoustic noises produced by the resonance between the output capacitor Cout of the boost circuit 105 and the PCB can be significantly suppressed. In addition, as the frequencies F1 to Fn of the pulsation current signals I1 to In used for respectively driving the LED strings LED1 to LEDn may also be different from each other, unnecessary oblique or horizontal stripes (i.e. wave noises) can be further avoided in the images displayed by the LCD.

In other embodiments of the present invention, the driver 107 may further select the pulsation current signal with the highest amplitude from the pulsation current signals I1 to In as a reference in response to the feedback of the pulsation current signals I1 to In, maintain the frequency of the selected object at 20 KHz or at a certain reference frequency larger than 20 KHz, and adjust by a multiple the frequencies of the non-selected objects. In this manner, it is unnecessary for the driver 107 to adjust one by one the frequencies of the pulsation current signals I1 to In corresponding to the LED strings LED1 to LEDn and make the frequencies reach 20 KHz or above. Hence, The pulsation current signals I1 to In having the same or different frequencies larger than or equal to 20 KHz can be generated by a simple frequency dividing means.

In other embodiments of the present invention, a setting parameter can be input to the driver 107 by means of external inputting. Therefore, the driver 107 may adjust the frequencies of the pulsation current signals I1 to In corresponding to the LED strings LED1 to LEDn according to the input setting parameter, so that all the frequencies of the pulsation current signals I1 to In corresponding to the LED strings LED1 to LEDn have a fixed multiple ratio. For example, when the frequency of the pulsation current signal I1 is 20 KHz (which is not limited thereto), the frequency of the pulsation current signal I2 is 30 KHz (that is, 20 KHz*1.5), the frequency of the pulsation current signal I3 is 45 KHz (that is, 30 KHz*1.5), the frequency of the pulsation current signal I4 is 67.5 KHz (that is, 45 KHz*1.5), and the rest can be deduced in the same manner till the pulsation current signal In, the details of which are not repeated herein.

Moreover, if the LED strings LED1 to LEDn in the LED module 101 are divided into zones, the system terminal can provide the setting signal ST corresponding to the LED strings of each zone for the driver 107 through a transmission mechanism similar to an inter integrated circuit ($I^2C$). Thereby, the driver 107 provides the pulsation current signals with different frequencies (but all larger than 20 KHz) and different duty cycles to drive the LED strings of each zone (that is, to control the LED backlight module by zones), so that the light source system 10 can be applied in the LCD adopting high dynamic ratio (HDR) display technology.

Figure 3:
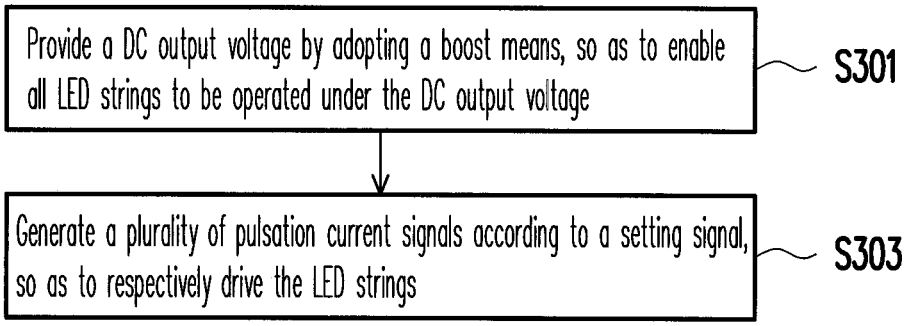
FIG. 3 is a flow chart of a method for driving LEDs according to an embodiment of the present invention.

Based on the teaching/description of the above embodiments, FIG. 3 is a flow chart of a method for driving LEDs according to an embodiment of the present invention. Referring to FIG. 3, the method for driving LEDs according to this embodiment is applicable to driving a plurality of LED strings, and includes the following steps. A DC output voltage is provided by adopting a boost means so as to enable all LED strings to be operated under the DC output voltage (S301). A plurality of pulsation current signals are generated according to a setting signal so as to respectively drive the LED strings (S303). In this embodiment, the frequencies of the generated pulsation current signals are all higher than a predetermined frequency, for example, a highest audio frequency in an audible acoustic wave range (20 Hz to 20 KHz), that is, 20 KHz, which is not limited thereto. Besides, the frequency of each generated pulsation current signal has a multiple relation with the predetermined frequency, and the multiple relation may be greater than or equal to an integral or a non-integral multiple of one. Furthermore, the frequencies of the generated pulsation current signals may be the same or different from each other, and the duty cycles of the generated pulsation current signals may also be the same or different from each other.

In summary, the present invention mainly designs the frequencies of the pulsation current signals for driving the respective LED strings into frequencies higher than the audible acoustic wave range (that is, 20 Hz to 20 KHz). Therefore, the intensities of the acoustic noises produced by the resonance between the output capacitor used in the adopted boost means and the PCB can be significantly suppressed. Moreover, as the frequencies of the pulsation current signals for driving the LED strings may also be designed into different values, unnecessary oblique or horizontal stripes (i.e. wave noises) can be avoided in the images displayed by the LCD if the light source system of the present invention is applied in the LCD system.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A light source system, comprising:

a light emitting diode (LED) module, comprising a plurality of LED strings operated under a direct current (DC) output voltage; and a driving unit, coupled to the LED module, and used for providing the DC output voltage by adopting a boost means and generating a plurality of pulsation current signals by adopting means of at least a random number or an increasing or decreasing function according to a setting signal, so as to respectively drive the LED strings, wherein frequencies of the pulsation current signals are higher than a predetermined frequency, wherein the predetermined frequency is a highest audio frequency in an audible acoustic wave range, and the highest audio frequency in the audible acoustic wave range is 20 KHz.

2. The light source system according to claim 1, wherein the driving unit comprises:

a boost circuit, used for receiving a DC input voltage and generating the DC output voltage after a boost processing of the DC input voltage; and a driver, used for receiving and analyzing the setting signal to generate the pulsation current signals.

3. The light source system according to claim 2, wherein when the boost circuit is under an over voltage, the generation of the DC output voltage is stopped.

4. The light source system according to claim 2, wherein the driver further adjusts the strength of the pulsation current signals according to a current setting value.

5. The light source system according to claim 1, wherein the frequencies of the pulsation current signals are the same or different from each other.

6. The light source system according to claim 5, wherein the frequency of each pulsation current signal is in a multiple relation with the predetermined frequency.

7. The light source system according to claim 6, wherein the multiple relation is greater than or equal to an integral or a non-integral multiple of one.

8. The light source system according to claim 7, wherein duty cycles of the pulsation current signals are the same or different from each other.

9. The light source system according to claim 1, wherein the light source system is at least an LED backlight module.

10. A method for driving light emitting diodes (LEDs), applicable to driving a plurality of LED strings, the method comprising:

providing a direct current (DC) output voltage by adopting a boost means so as to enable the LED strings to be operated under the DC output voltage; and generating a plurality of pulsation current signals by adopting means of at least a random number or an increasing or decreasing function according to a setting signal, so as to respectively drive the LED strings, wherein frequencies of the pulsation current signals are higher than a predetermined frequency, wherein the predetermined frequency is a highest audio frequency in an audible acoustic wave range, and the highest audio frequency in the audible acoustic wave range is 20 KHz.

11. The method according to claim 10, wherein the frequencies of the pulsation current signals are the same or different from each other.

12. The method according to claim 11, wherein the frequency of each pulsation current signal is in a multiple relation with the predetermined frequency.

13. The method according to claim 12, wherein the multiple relation is greater than or equal to an integral or a non-integral multiple of one.

14. The method according to claim 13, wherein duty cycles of the pulsation current signals are the same or different from each other.

* * * * *